US005190830A

United States Patent [19]

Matsuo et al.

[11] Patent Number: 5,190,830

[45] Date of Patent: Mar. 2, 1993

[54] METHOD OF FORMING A UNIFORM COATING BY ELECTRODEPOSITION ON INTEGRATED FERROUS AND NON-FERROUS MATERIALS AND PRODUCT THEREOF

[75] Inventors: Katsuhiko Matsuo, Ibaraki; Takeshi Kuninori, Sakai, both of Japan

[73] Assignee: Shinto Paint Co., Ltd., Amagasaki, Japan

[21] Appl. No.: 722,145

[22] Filed: Jun. 27, 1991

[30] Foreign Application Priority Data

Jun. 29, 1990 [JP] Japan ..... 2-172955

[51] Int. Cl.[5] ..... C25D 13/12

[52] U.S. Cl. ..... 428/626; 204/181.1; 204/181.2; 204/181.3; 205/114; 428/653

[58] Field of Search ..... 204/16, 29, 181.1, 181.2, 204/181.3; 428/626, 653; 205/114, 188, 201, 317, 50

[56] References Cited

U.S. PATENT DOCUMENTS 3,674,670 7/1972 Erikson et al. ..... 204/181.1
3,674,671 7/1972 Stromberg ..... 204/181
3,787,338 1/1974 Skelly et al. ..... 260/29.2 N

FOREIGN PATENT DOCUMENTS 56149483 11/1991 Japan .

OTHER PUBLICATIONS

Robert C. Weast, Handbook of Chemistry and Physics, CRC Press, Cleveland, 1977, pp. D-171 to D-172.

Database WPIL, Accession No. 90-087759 [12], Derwent Publications, JP-A-2 041 348 Feb. 9, 1990 (Aishin Kako K.K.).

*Primary Examiner*—John Niebling
*Assistant Examiner*—William T. Leader
*Attorney, Agent, or Firm*—Wenderoth, Lind & Ponack

[57] ABSTRACT

A shaped or unshaped article of a non-ferrous metal sheet preferably aluminum having an organic, surface coating film containing conductive and/or semiconductive fine particles, preferably molybdenum dissulfide is integrally bonded with a shaped or unshaped article of a steel sheet having or not having an organic, surface coating film; and this integrated body is subjected simultaneously to electrodeposition coating.

The non-ferrous metal sheet having an organic, surface coating film containing conductive and/or semiconductive, fine particles shows excellent electrodeposition coating characteristics which can be easily regulated. Hence, integral coating after bounding with a steel sheet gives the same degree of film thickness and surface smoothness on both of the non-ferrous metal and steel sheets. This method is particularly suitable for the coating of automobile bodies integrally composed of non-ferrous metal and steel sheets ensuring energy- and labor-saving and giving final products of uniform finish.

10 Claims, No Drawings

METHOD OF FORMING A UNIFORM COATING BY ELECTRODEPOSITION ON INTEGRATED FERROUS AND NON-FERROUS MATERIALS AND PRODUCT THEREOF

BACKGROUND OF THE INVENTION

1. Field of the Invention

This invention relates to a method of forming a uniform coating by electrodeposition on integrated ferrous and non-ferrous materials having dissimilar electrically conductive characteristics, which coating is characterized by a high degree of electrodeposition coating characteristics, high uniformity of film thickness and good appearance, which comprises integrally attaching a shaped or unshaped article of a non-ferrous metal sheet (such as an aluminum alloy sheet) having an organic, surface coating film containing conductive and/or semiconductive fine particles, to a shaped or unshaped article of a steel sheet having or not having an organic, surface coating film; and subjecting both of the articles simultaneously to electrodeposition coating.

2. Description of Related Prior Art

The coating process generally employed for automobile bodies is to subject cold-rolled and dull-finished steel sheets to electrodeposition coating after preliminary surface treatment, followed by intercoating and topcoating. For the purpose of enhancing corrosion resistance, another process has been recently employed, which comprises plating steel sheets with zinc, a nickel-zinc alloy or an iron-zinc alloy, and applying a coating composition (for example, an organic composition containing a high-molecular epoxy resin as a base resin and colloidal silica to a dry thickness of about 1μ, ZINCRO METAL containing a large amount of zinc powder and an epoxy resin as binder to a dry thickness of about 15μ, and an organic, coating composition containing zinc powder and stainless steel powder to a dry thickness of 5 to 7μ), followed by electrodeposition coating, intercoating and topcoating.

In addition, as a result of recent demand for lighter-weight automobiles, the use of a non-ferrous metal of low specific gravity (typified by aluminum) in place of steel sheets has drawn attention and has been put into practice by some manufacturers. However, these lightweight metals differ from a ferrous metal (such as steel) in electrical resistance and surface characteristics, and hence, attachment of these two different metals followed by simultaneous electrodeposition coating results in a different thickness and appearance of the coated film on the two metals. Furthermore, preliminary treatment of the steel sheet is liable to form an uneven surface on the lighweight metal, thus resulting in film defects in the following electrodeposition coating step.

A variety of methods have been proposed to avoid these problems. These include a method in which the lightweight metal's (such as aluminum) surface is first chrome-plated and then attached to steel sheets, and the steel sheets are subjected to the usual surface treatment, followed by electrodeposition coating; and a method in which the non-ferrous metal surface is coated with an organic, coating composition containing silica (which is used for multi-layer coated steel sheets) to a thickness less than 1μ and then attached to steel sheets, and the steel sheets are subjected to the usual surface treatment, followed by electrodeposition coating.

These conventional methods serve to protect the surface of the non-ferrous metal sheets during the step of treating the steel-sheet surface thanks to the preliminary treatment or the applied organic coating, thus preventing surface non-uniformity and other defects to some extent. But these methods still involve the problem that a difference in film thickness is unavoidable because the electric characteristics of the non-ferrous metal and steel sheets cannot be regulated completely.

The present inventors have conducted intensive research on the idea that the uniformity, thickness and other characteristics of a film formed by electrodeposition coating could be freely regulated if the surface characteristics of a non-ferrous metal could be controlled by a film coated thereon. They have discovered that the formation of an organic film containing conductive and/or semiconductive fine particles gives electrodeposition characteristics that may fit for any surface characteristics of steel sheets. This invention was accomplished on the basis of these findings.

SUMMARY OF THE INVENTION

Thus, this invention provides a method of forming a uniform integral coating on integrated ferrous and non-ferrous materials by electrodeposition, which comprises integrally attaching a shaped or unshaped article of a non-ferrous metal sheet having an organic, surface coating film containing conductive and/or semiconductive fine particles to a shaped or unshaped article of a steel sheet having or not having an organic, surface coating film; and subjecting both of the articles simultaneously to electrodeposition coating. The invention also provides coated articles made by the method described above. This invention will be explained below in more detail.

This invention relates to a method of forming a uniform electrodeposition coating for articles made from different metals, which comprises coating a non-ferrous metal sheet with a coating composition containing conductive and/or semiconductive, fine particles after having conducted a preliminary surface treatment, thus forming an organic film containing conductive and/or semiconductive, fine particles on the surface thereof; fabricating the non-ferrous metal sheet thus treated with or without a previous application of a lubricant; attaching it to a surface-treated or untreated, steel sheet which may optionally have an organic, surface coating film; and subjecting both of the metal sheets simultaneously to electrodeposition coating.

As examples of the non-ferrous metal used in this invention, there may be mentioned, among others, aluminum and alloys thereof, titanium and alloys thereof, magnesium and alloys thereof, as well as zinc, tin, and alloys thereof. As the preliminary surface treatment of the non-ferrous metal sheets, there may be used the methods commonly employed for aluminum, other non-ferrous metals and alloys thereof, such as anodizing (e.g., phosphoric-acid anodized treatment, sulfuric-acid anodized treatment and oxalic-acid anodized treatment), chromic-acid chromate treatment, phosphoric-acid chromate treatment, zirconium salt treatment, organic-acid metal salt treatment and chromate conversion coating.

On the surface of the non-ferrous metal sheet subjected to such a surface treatment, there is then formed an organic film containing conductive and/or semiconductive, fine particles by coating the surface with a composition containing these fine particles. As examples of such conductive and semiconductive, fine particles, there may be mentioned those of conductive carbon, graphite, molybdenum disulfide, conductive zinc oxide, tin oxides, triiron tetraoxide, iron phosphide, zinc and stainless steel. Of these, molybdenum disulfide is the most effective in terms of electrical characteristics and fabrication quality. The content of these conductive and/or semiconductive, fine particles in the above coating composition should be in the range from 1 to 70 weight %, preferably from 5 to 50 weight %. If the content is less than 1 weight %, sufficient current required for the following electrodeposition coating will not flow, thus resulting in poor electrodeposition characteristics. On the other hand, a content exceeding 70 weight % will worsen the characteristics of the formed film. Particularly when molybdenum disulfide is contained as semiconductive, fine particles, the content should be in the range from 5 to 70 weight %, preferably from 10 to 50 weight %, in order to ensure sufficient lubricity in the fabrication step. The above conductive and/or semiconductive, fine particles may be used either alone or in combination, but when molybdenum disulfide is used as the semiconductive, fine particle and other conductive, fine particles are added as required, the amount of the latter particles should be 20% or less, preferably in the range from 5 to 10%, based on the weight of molybdenum disulfide. An increased amount of the conductive, fine particles will increase the current flow and the critical film thickness in the electrodeposition coating step; however, if the amount exceeds 20 weight %, the good fabrication quality characteristic of molybdenum disulfide is adversely affected. The above coating composition also contains a resin to disperse the conductive and/or semiconductive, fine particles. There is no specific limitation upon the type of this resin insofar as being a resin commonly used in coating compositions, but those which are particularly suited for the purpose of this invention are a blocked-isocyanate-curable epoxy resin, a melamine-curable, oil-free polyester resin, a melamine-curable, linear polyester resin, an amide-curable epoxy resin, a melamine-curable acrylic resin, a blocked-isocyanate-curable, oil-free polyester resin, a mixture of blocked-isocyanate-curable, oil-free polyester resin and epoxy resin, and a blocked-isocyanate-curable, epoxidized ester.

In addition, the coating composition may contain a flow control agent (such as colloidal silica and bentonite), a coloring pigment, a levelling agent, an anti-sagging agent, an anti-foaming agent, a dispersant, a suspending agent, an anti-blocking agent (such as polyethylene wax) and other additives used in ordinary paint in an amount that will not adversely affect the characteristics of coated film. The coating composition used in this invention is prepared by dispersing the conductive and/or semiconductive, fine particles by the use of a dispersion mixer (such as a ball mill, a steel mill, an attritor mill, a sand mill and a roll mill), adding a resin and additives to the dispersion thus obtained, and adjusting the viscosity to a proper level by addition of an organic solvent.

As examples of the solvent to be used, there may be mentioned aromatic hydrocarbon solvents, aliphatic hydrocarbon solvents, ketone solvents, ester solvents and ether solvents, which are used either alone or in combination without any limitation.

The coating composition thus prepared should preferably be applied to a dry thickness in the range from 0.05 to 20μ, more preferably in the range from 1 to 5μ. Coating may be performed by the methods commonly employed, such as roll coating, spray coating, electrostatic coating and electrodeposition coating, and roll coating is the most suited for precoated metals in terms of coating speed and uniformity of dried film. If the dry film thickness is less than 0.05μ, enhancement of corrosion resistance cannot be expected by the coating. A dry film thickness exceeding 20μ, on the other hand, will result in poor current flow, thus adversely affecting the electrodeposition characteristics and causing film destruction during fabrication. The coating should be dried and baked at a temperature in the range from room temperature to 300° C., preferably in the range from 20° to 250° C.

The organic film thus formed shows excellent electrodeposition characteristics. Particularly, the film containing molybdenum disulfide as semiconductive, fine particles also shows excellent fabrication quality; hence, fabrication can be readily performed by any known method with no need for applying a lubricant, followed by electrodeposition coating.

As examples of the steel sheet to be attached to the above-described non-ferrous metal, there may be mentioned SPC dull-finished steel sheets, bright-finished steel sheets, and alloy-plated steel sheets (such as Zn-Ni plated and Zn-Fe plated steel sheets) with or without preliminary surface treatment. The surface treatment may be performed by a method commonly employed for steel sheets and alloy-plated sheets, such as degreasing, zinc phosphate treatment after washing with water, and chromate treatment.

These steel sheets are optionally coated with an organic, coating composition conventionally used for multi-layer coated steel sheets (for example, an organic composition containing a high-molecular epoxy resin as a base resin and colloidal silica to a dry thickness of about 1μ, ZINCRO METAL containing a large amount of zinc powder and an epoxy resin as binder to a dry thickness of about 15μ, an organic, coating composition containing zinc powder and stainless steel powder to a dry thickness of 5 to 7μ, and a coating composition containing conductive and/or semiconductive, fine particles as described above). The sheets thus treated are then shaped optionally, and bonded with shaped or unshaped, non-ferrous metal sheets containing conductive and/or semiconductive, fine particles, followed by simultaneous electrodeposition coating.

For example, a shaped, aluminum automobile part (e.g., a fender and a bonnet) having an organic surface coating film containing conductive and/or semiconductive, fine particles is assembled on the automobile body, and both are then subjected to electrodeposition coating.

Electrodeposition coating can be performed in the usual way. For example, anionic, electrodeposition coating materials (such as polycarboxylic acid resins) and cationic, electrodeposition coating materials (such as amine-modified epoxy resins, amine-modified polyurethane polyol resins, amine-modified polybutadiene resins), one-coat acrylic cationic electrodeposition coating materials and high build type, cationic electrodeposition coating materials may be used without any limitation. But cationic, electrodeposition coating materials including low-temperature curable materials are the most suited for the coating of automobiles which is the main object of this invention. Coating voltage should be in the range from 50 to 400 V, preferably in the range from 80 to 250 V. If the voltage is less than 50 V, a sufficiently high film thickness cannot be achieved, while a voltage exceeding 400 V is liable to cause film destruction. It is therefore necessary to select a proper voltage within the above range depending on the coating bath conditions in order to achieve a desired film thickness. The film thickness, which should preferably be about 20μ, may vary depending on the coating bath temperature; hence, the bath temperature should be in the range from 25° to 30° C., preferably should be 27°±1° C. The current passage time may be varied depending on the voltage to adjust the film thickness, but the suitable time is 2 to 5 minutes (usually 3 minutes). After performing electrodeposition coating under the conditions described above, the coating is washed with water and baked at 120° to 200° C. for 20 to 30 minutes, thus completing film formation.

The electrodeposition film thus formed by the integral coating process is excellent in corrosion resistance, smoothness and topcoating characteristics on both of the steel and non-ferous metal surfaces, and the difference in film thickness between the two is extremely small.

Particularly when a non-ferrous metal sheet having an organic, surface coating film containing molybdenum disulfide as semiconductive, fine particles is subjected to electrodeposition coating, the current begins to flow gradually and hence the electrodeposition film is formed very slowly, because the above organic, surface coating film works like a varistor (showing no electrical conductivity when the applied voltage is less than a specific level and showing electrical conductivity only when the voltage reaches the specific level).

The following Examples and Reference Examples will further illustrate the invention.

DETAILED DESCRIPTION OF THE PREFERRED EMBODIMENTS

EXAMPLE 1 THROUGH 4 AND REFERENCE EXAMPLES 1 AND 2

An aluminum sheet 0.8 mm thick was subjected to chromate treatment, coated with each of the organic, surface coating compositions containing semiconductive, fine particles as listed in Table 1 by the use of a bar coater, dried by heating at 210° C. for one minute, and washed with water and dried. The aluminum sheet thus treated was attached to a steel sheet 0.8 mm thick previously subjected to Bonderite #3020 treatment by using bolts and nuts, the sheets thus attached together were simultaneously subjected to electrodeposition coating as described below, and the electrodeposition characteristics and topcoat sharpness were evaluated. The results obtained are summarized in Table 2. In Reference Example 2, however, there was used ZINCRO METAL.

Described below are the conditions adopted in these examples.

(I) Formulations of the organic, surface coating compositions containing semiconductive, fine particles for aluminum sheets, and preparative methods thereof

| (Surface coating composition used in Example 1) | |
|---|---|
| (1) $MoS_2$ (Mori Powder -PS; product of Sumiko Junkatsuzai) | 50 parts by weight |
| (2) $SiO_2$ (MIZUKASIL p-526; product of Mizusawa Kagaku) | 0.7 part by weight |
| (3) Epoxy resin (EP-1009; product of Shell Oil Co.) | 48.1 parts by weight |
| (4) Dicyandiamide (Adeka Hardener HT-2844; product of Asahi Denka) | 1.0 part by weight |

-continued

| (Surface coating composition used in Example 1) | |
|---|---|
| (5) Butyl cellosolve | 51.2 parts by weight |
| (6) Methyl ethyl ketone | 71.6 parts by weight |
| (7) Dispersant | 0.2 part by weight |
| Total | 222.8 parts by weight |

Components (3) through (6) were mixed together, and stirring was continued until a clear solution was obtained. To a part of the solution thus obtained, were added components (1), (2) and (7) with stirring, the mixture was treated in an experimental sand mill for 45 to 60 minutes in the presence of glass beads added, and the dispersion obtained after filtration was used as the test sample. Compositions for Examples 2 through 4 and Reference Examples 1 and 2 are shown in Table 1. Those for Examples 2 through 4 were prepared in the same way as above. The composition for Reference Example 1, which contains no pigment, was prepared by simple stirring in a dissolver.

(II) Electrodeposition coating characteristics

Succed #700 Gray (a cationic, electrodeposition coating material; product of Shinto Paint Co., Ltd.) was put in a coater bath at a concentration of 18 weight %, and an integral body composed of a steel sheet and an aluminum sheet having an organic, surface coating film containing semiconductive, fine particles as described above was subjected to electrodeposition coating at a voltage of 200 V at 28° C. for three minutes, followed by baking at 170° C. for 20 minutes, thus forming a film 20±1μ thick on the aluminum sheet surface. Its surface appearance and thickness were observed, and evaluated according to the standards shown below.

(1) Surface smoothness
- ◎: 1μ>Good smoothness
- ○: 2μ>Good smoothness
- Δ: 3μ>Somewhat poor smoothness
- ×: Uneven film; pinholes and uncoated parts observed (2) Uniformity of film thickness
Difference in average film thickness between aluminum and steel sheets
- ○: Less than 2μ
- Δ: Less than 5μ
- ×: 5μ or more (III) Sharpness of topcoat Electrodeposition film was formed under the conditions described in Paragraph (II) above to a thickness of 20±1μ, GULIMIN #100 white intermediate coat (a polyester-melamine resin for automobile intercoating; product of Shinto Paint Co., Ltd.) was then coated to a dry thickness of 30 to 35μ and baked at 140° C. for 20 minutes, and GULIMIN #100 white topcoat (product of Shinto Paint Co., Ltd.) was further coated to a dry thickness of 30 to 35μ and baked at 140° C. for 20 minutes.

The smoothness of the film thus formed was measured by the use of I.C.M (image clarity meter) and P.G.D.

(IV) Physical properties

An aluminum sheet previously subjected to chromate treatment as described above was coated with each of the coating compositions listed in Table 1 (for each of the Examples and Reference Examples) to a thickness of 1μ by using a bar coater, and baked at 210° C. for 60 seconds, giving a test piece.

(1) Bending test

A bending test at a bend radious of 3 mmϕ was carried out, a sheet of cellophane adhesive tape was stuck to the bent section and stripped off, and the degree of film peeling was decided.

○: No peeling

Δ: Slight powdering and peeling observed

×: Peeling and powdering observed (2) Erichsen test

An Erichsen test was carried out with the punch being extruded by 8 mm, a sheet of cellophane adhesive tape was stuck to the extrusion portion and stripped off, and the peeling and powdering of the film was observed.

○: Neither peeling nor powdering observed

Δ: Slight powdering and peeling observed

×: Peeling and powdering observed

TABLE 1

| | | | Resin | | Hardener | | | |
|---|---|---|---|---|---|---|---|---|
| | $MoS_2$ | Conductive Carbon | Epoxy Resin; EP-1009 (Shell Chemical) | Acrylic Resin; DIANAL HR-686 (Mitsubishi Rayon) | Melamine Resin; SUMIMAL 40S (Sumitomo Chemical) | Dicyandiamide; Adeka Hardener HT-2844 (Asahi Denka) | Pigment Dispersant | $SiO_2$ |
| Example 1 | 50 | | 48.1 | | | 1.0 | 0.2 | 0.7 |
| Example 2 | 10 | | 87.3 | | | 1.8 | 0.2 | 0.7 |
| Example 3 | 47 | 3 | 48.1 | | | 1.0 | 0.2 | 0.7 |
| Example 4 | | 5 | | 65.5 | 28.0 | | 0.2 | 1.3 |
| Reference Example 1 | | | 87.8 | | | 2.0 | 1.0 | 9.2 |
| Reference Example 2 | | | | ZINCRO METAL | | | | |

Remarks:

(1) All the figures in the table are solid content expressed by weight %.

(2) Each of the coating compositions was tested after dilution with a solvent mixture (butyl cellosolve, methyl ethyl ketone, and xylene) to a viscosity suit for coating.

Remarks:

(1) All the figures in the table are solid content expressed by weight %.

(2) Each of the coating compositions was tested after dilution with a solvent mixture (butyl cellosolve, methyl ethyl ketone, and xylene) to a viscosity suit for coating.

TABLE 2

| | | Electrodeposition Coating Characteristics | | Sharpness of Topcoat | | Physical Properties | |
|---|---|---|---|---|---|---|---|
| Item | Film Thickness* | Surface Smoothness | Film Thickness Uniformity | I.C.M | P.G.D | Bending | ERICHSEN |
| Example 1 | 1 | ◎ | ○ | 80 | 1.0 | ○ | ○ |
| | 5 | ◎ | ○ | 81 | 0.9 | ○ | ○ |
| Example 2 | 1 | ◎ | ○ | 82 | 1.0 | ○ | ○ |
| Example 3 | 1 | ◎ | ○ | 80 | 1.0 | ○ | ○ |
| | 5 | ◎ | ○ | 79 | 0.9 | ○ | ○ |
| | 10 | ◎ | ○ | 78 | 0.9 | ○ | ○ |
| Example 4 | 1 | ◎ | ○ | 75 | 0.8 | ○ | ○ |
| | 5 | ◎ | ○ | 78 | 0.8 | ○ | ○ |
| | 10 | ◎ | ○ | 75 | 0.7 | ○ | ○ |
| Reference Example 1 | 1 | X | X | 62 | 0.5 | ○ | ○ |
| Reference Example 2 | 15 | ◎ | ○ | 74 | 0.7 | X | X |

*Thickness (μm) of the organic, surface coating film containing semiconductive, fine particles formed on aluminum sheet

EXAMPLE 5

An aluminum sheet 0.8 mm thick was coated with the organic, surface coating composition used in Example 1 to a thickness of 1 μ, followed by baking, coating of a lubricant, and fabrication. The sample thus obtained was attached to a part of an automobile body (made of steel), passed through a cleaning line, and subjected to cationic, electrodeposition coating.

The result is shown in Table 3.

EXAMPLE 6

A duralumin sheet 0.8 mm thick was coated with the organic, surface coating composition containing semiconductive, fine particles used in Example 1 to a thickness of 1 μ. Separately, a steel sheet 0.8 mm thick previously treated with PALBOND #3020 was also coated with the same coating composition as above to a thickness of 1 μ. These two sheets were attached together, and subjected to cationic, electrodeposition coating in the same way as in Example 1.

The result is shown in Table 3.

Reference Example 3

An aluminum sheet 0.8 mm thick previously subjected to phosphoric-acid anodized treatment was attached to an SPC dull-finished steel sheet previously treated with PALBOND #3020, and the integrated body was then subjected to cationic, electrodeposition coating in the same way as in Example 1.

The result is shown in Table 3.

TABLE 3

| | Electrodeposition Coating Characteristics | | | | | |
|---|---|---|---|---|---|---|
| | Surface Smoothness | | Film Thickness Uniformity | | Average Film Thickness (μ) | |
| Item | Aluminum or Duralumin | Steel Sheet | Aluminum or Duralumin | Steel Sheet | Aluminum or Duralumin | Steel Sheet |
| Example 5 | ◎ | ◎ | ○ | ○ | 22 | 21 |
| Example 6 | ◎ | ◎ | ○ | ○ | 22 | 22 |
| Reference Example 3 | ○ | ◎ | ○ | ○ | 26 | 21 |

According to this invention, the non-ferrous metal sheet having an organic, surface coating film containing conductive and/or semiconductive, fine particles shows excellent electrodeposition coating characteristics which can be easily regulated. Hence, the coating formed after connecting a non-ferrous metal sheet with a steel sheet give the same degree of film thickness and surface smoothness on both of the non-ferrous metal and steel sheets. Particularly in the process of electrodeposition coating on an automobile body integrally composed of non-ferrous metal and steel sheets (needed by recent demand for lightweight automobiles), it is possible to perform on-line coating (comprising degreasing, washing with water, surface treatment and electrodeposition coating) without having to subject the non-metal sheets to off-line coating, thereby ensuring savings in energy and labor while providing final products of uniform finish. In addition, the use of a surface film containing molybdenum disulfide, which shows high lubricity, reduces the amount of lubricant to be used and the frequency of its use, or completely eliminates the need for its use, thereby ensuring energy-saving.

What we claim is:

1. A method of forming a uniform coating on integrated ferrous and non-ferrous metal articles by electrodeposition, which comprises the steps of:

precoating the non-ferrous metal article with an organic surface coating film containing fine particles of molybdenum disulfide, the non-ferrous metal article being comprised of aluminum or aluminum alloy, attaching the ferrous metal article to the non-ferrous metal article, and coating the attached non-ferrous and ferrous metal articles simultaneously by electrodeposition, wherein the organic surface coating film containing fine particles of molybdenum disulfide on the non-ferrous metal article enables a uniform coating to be formed simultaneously on the integrated non-ferrous and ferrous metal articles by electrodeposition despite the dissimilar electrical conductivities of the metal articles.

2. The method according to claim 1, wherein the organic surface coating film contains 1 to 70% of fine particles of molybdenum disulfide.

3. The method according to claim 1, wherein the organic surface coating film contains 5 to 50% of fine particles of molybdenum disulfide.

4. The method according to claim 1, wherein the ferrous metal article is comprised of a steel sheet plated with a metal or alloy.

5. The method according to claim 1, wherein the ferrous metal article is prepared by plating a steel sheet with an alloy followed by coating the ferrous metal article with an organic coating film, before the ferrous metal article is attached to the non-ferrous metal article.

6. An integrated article comprising integrated ferrous and non-ferrous metal articles having a uniform outer coating formed simultaneously on the integrated ferrous and non-ferrous metal articles by electrodeposition, said coated integrated article being produced by:

precoating the non-ferrous metal article with an organic surface coating film containing fine particles of molybdenum disulfide, the non-ferrous metal article being comprised of aluminum or aluminum alloy, attaching the ferrous metal article to the non-ferrous metal article, and coating the attached non-ferrous and ferrous metal articles simultaneously by electrodeposition, wherein the organic surface coating film containing fine particles of molybdenum disulfide on the non-ferrous metal article enables a uniform coating to be formed simultaneously on the integrated non-ferrous and ferrous metal articles by electrodeposition despite the dissimilar electrical conductivities of the metal articles.

7. The method according to claim 6, wherein the organic surface coating film contains 1 to 70% of fine particles of molybdenum disulfide.

8. The method according to claim 6, wherein the organic surface coating film contains 5 to 50% of fine particles of molybdenum disulfide.

9. The method according to claim 6, wherein the ferrous metal article is comprised of a steel sheet plated with a metal or alloy.

10. The method according to claim 6, wherein the ferrous metal article is prepared by plating a steel sheet with an alloy followed by coating the plated steel sheet with an organic coating film, before the plated steel sheet is attached to the non-ferrous metal article and coated by electrodeposition.

* * * * *